US008838363B2

(12) United States Patent
Surnilla et al.

(10) Patent No.: US 8,838,363 B2
(45) Date of Patent: Sep. 16, 2014

(54) METHOD FOR INJECTING FUEL

(75) Inventors: Gopichandra Surnilla, West Bloomfield, MI (US); Richard E. Soltis, Saline, MI (US); James Michael Kerns, Trenton, MI (US); Stephen B. Smith, Livonia, MI (US); Imad Hassan Makki, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 275 days.

(21) Appl. No.: 13/356,843

(22) Filed: Jan. 24, 2012

(65) Prior Publication Data

US 2013/0191008 A1 Jul. 25, 2013

(51) Int. Cl.

| | |
|---|---|
| ***F02D 41/30*** | (2006.01) |
| ***F02D 41/14*** | (2006.01) |
| *F02D 41/00* | (2006.01) |

(52) U.S. Cl.

CPC ..... *F02D 41/144* (2013.01); *F02D 41/0042* (2013.01)

USPC ..... 701/104; 123/704

(58) Field of Classification Search

CPC ... F02D 41/144; F02D 41/0042; F02D 41/08; F02D 41/16

USPC ..... 701/104, 109, 101–103; 123/704, 698, 123/516, 518–520, 568.14, 572, 574

See application file for complete search history.

(56) References Cited

U.S. PATENT DOCUMENTS

| | | | | |
|---|---|---|---|---|
| 4,727,849 | A | 3/1988 | Nishida et al. | |
| 4,823,760 | A * | 4/1989 | Nishida | 123/406.48 |
| 5,331,940 | A * | 7/1994 | Takayama | 123/679 |
| 6,000,385 | A * | 12/1999 | Fukuma | 123/704 |
| 6,371,086 | B1 * | 4/2002 | Matsubara et al. | 123/500 |
| 6,739,177 | B2 | 5/2004 | Sato et al. | |
| 7,150,264 | B2 * | 12/2006 | Kobayashi et al. | 123/376 |
| 8,036,812 | B2 * | 10/2011 | Vigild et al. | 701/103 |
| 2002/0029768 | A1 * | 3/2002 | Matsubara et al. | 123/500 |
| 2002/0139360 | A1 | 10/2002 | Sato et al. | |
| 2003/0106530 | A1 * | 6/2003 | Kitajima et al. | 123/406.48 |
| 2007/0044472 | A1 | 3/2007 | Zhang | |
| 2007/0119420 | A1 * | 5/2007 | Leone et al. | 123/431 |
| 2007/0283933 | A1 * | 12/2007 | Magner et al. | 123/491 |

FOREIGN PATENT DOCUMENTS

JP 2006342786 A * 12/2006

* cited by examiner

*Primary Examiner* — Mahmoud Gimie

(74) *Attorney, Agent, or Firm* — Julia Voutyras; Alleman Hall McCoy Russell & Tuttle LLP

(57) ABSTRACT

Embodiments for adjusting fuel injection are provided. In one example, a method comprises adjusting fuel injection based on fuel concentration in an engine intake manifold, and during idle and when EGR is disabled, adjusting fuel injection based on the fuel concentration and a fuel pushback amount. In this way, fuel injection may be adjusted based on fuel concentration in the intake manifold.

16 Claims, 7 Drawing Sheets

OXYGEN SENSOR RESPONSE IN BUTANE HIGH FLOW $$2C_4H_{10} + 13O_2 \rightarrow 8CO_2 + 10H_2O$$

METHOD FOR INJECTING FUEL

FIELD

The present disclosure relates to fuel injection in an engine.

BACKGROUND AND SUMMARY

Fuel injection amounts are typically set based on a desired air/fuel ratio and adapted using feedback from one or more exhaust gas sensors in the exhaust. Fueling errors may occur, however, during operating conditions where fuel vapors are present in the intake. For example, fuel vapor canisters designed to trap fuel vapors from the fuel tank are periodically purged to the intake, and these vapors may result in an excess amount of fuel in the cylinders, wasting fuel and degrading emissions.

Previous solutions to account for the amount of fuel originating from the fuel vapor canister have relied on purge flow estimates, based on purge duration and other parameters. However, these estimates are frequently inaccurate. Further, these estimates don't take into account additional sources of intake fuel, such as fuel from the positive crankcase ventilation system or pushback fuel.

The inventors have recognized the issues with the above approach and offer a method to at least partly address them. In one embodiment, a method comprises adjusting fuel injection based on fuel concentration in an engine intake manifold, and during idle and when EGR is disabled, adjusting fuel injection based on the fuel concentration and a fuel pushback amount. In this way, fuel injection may be adjusted based on fuel vapors present in the intake, for example, from both a fuel vapor canister purge and from a positive crankcase ventilation system. In one example, these fuel vapor amounts may be determined based on an oxygen sensor present in the intake. Further, the fuel injection may be additionally adjusted based on an amount of pushback fuel, for example from fuel evaporated from a fuel puddle on an intake valve or port.

By determining the amount of fuel in the intake based on a signal from an oxygen sensor, fuel injection amounts may be adjusted to maintain desired air/fuel ratio in the cylinder. Depending on operating conditions, the intake oxygen concentration may be able to provide an indication of an amount of ambient humidity, fuel vapors from various sources, and/or an amount of exhaust gas recirculation in the intake. By determining these amounts in some conditions and modeling them in other conditions, optimal air/fuel ratio may be maintained, improving fuel economy and reducing emissions. Further, the amount of vapors can also be adjusted based on feedback from exhaust air-fuel ratio sensors, purge flow estimates, purge duration, and other parameters if desired.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
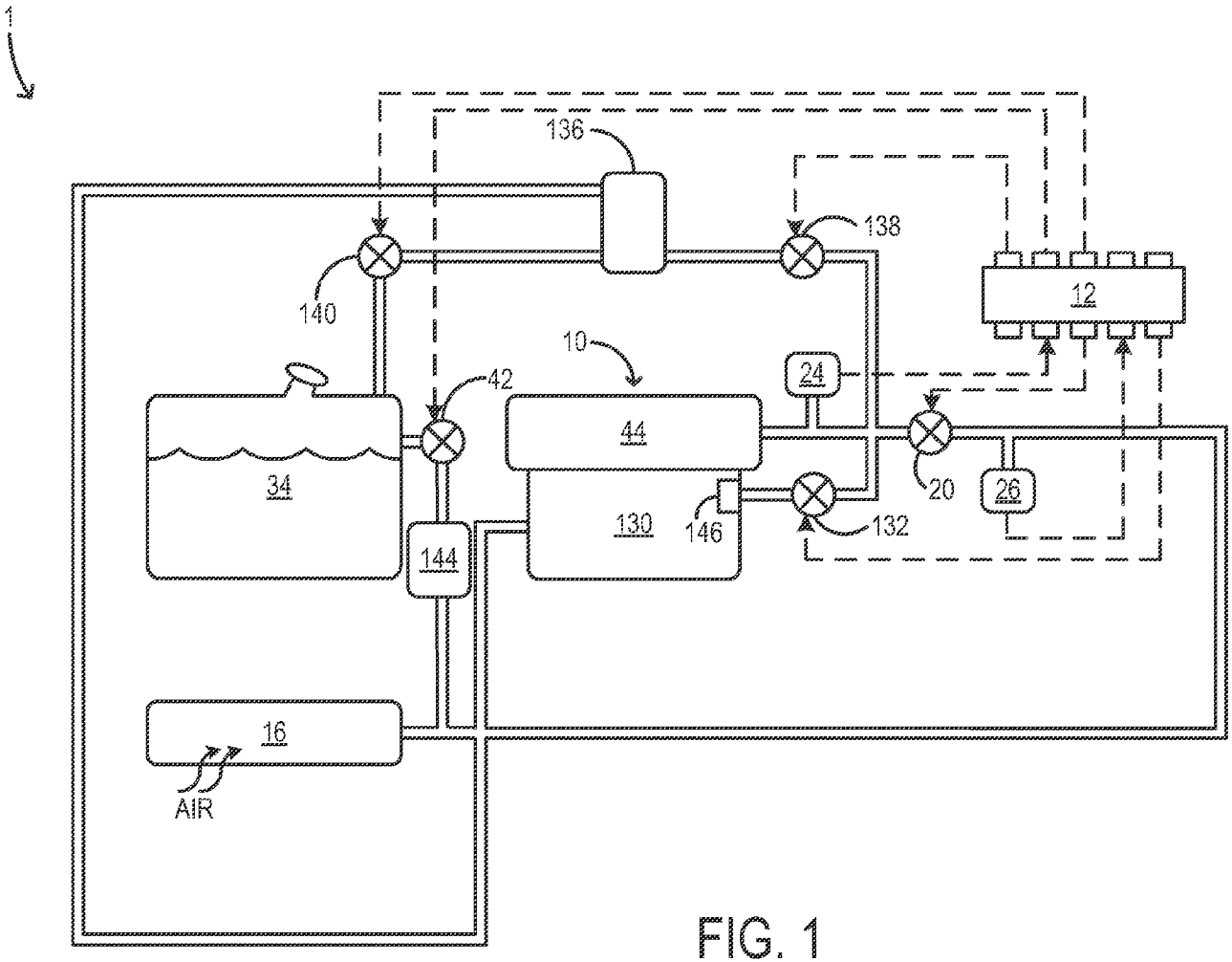
FIG. 1 shows an example engine system according to an embodiment of the present disclosure.
Figure 2:
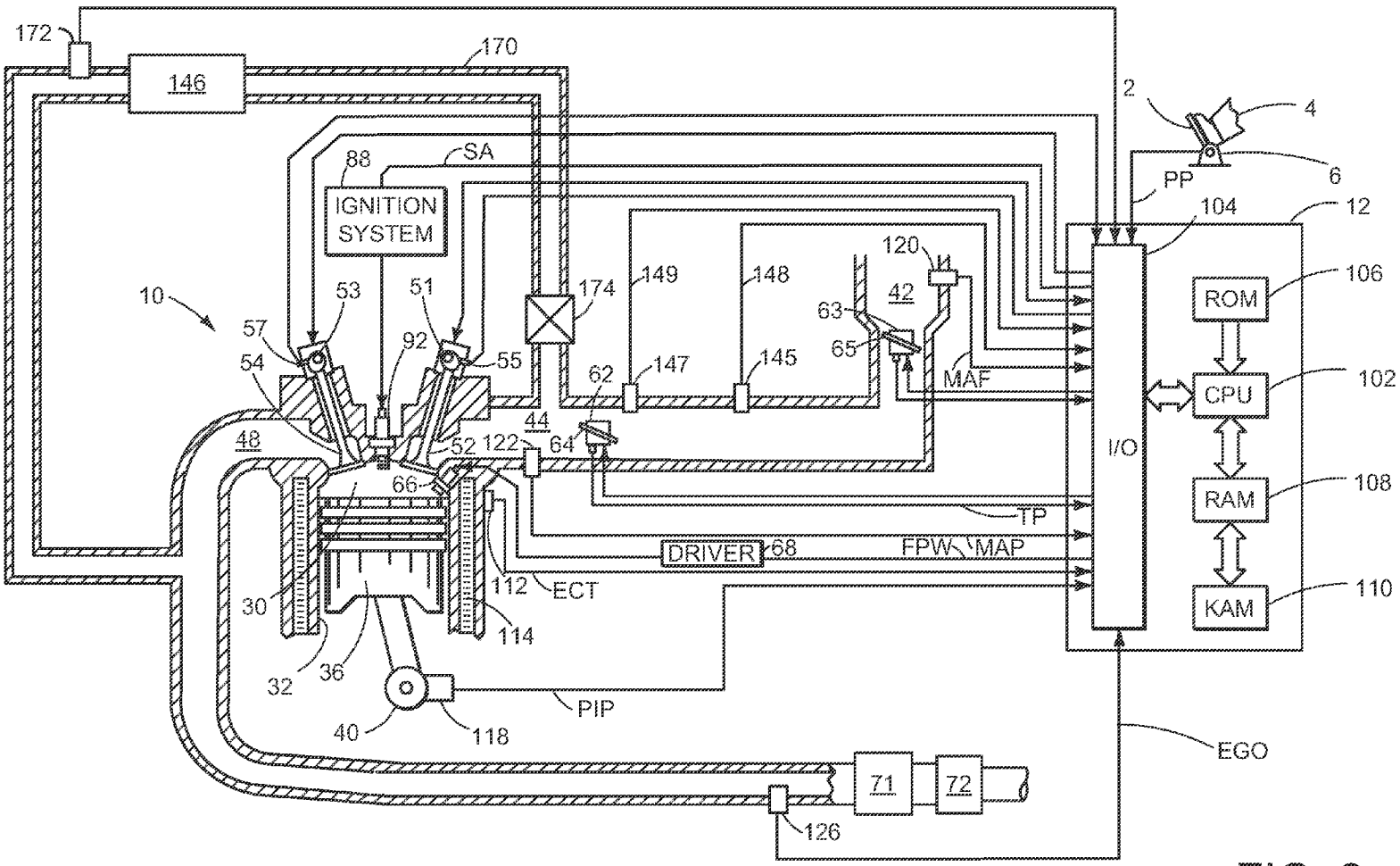
FIG. 2 shows a single cylinder of the multi-cylinder engine of FIG. 1.

An oxygen sensor positioned in the intake of an engine may be able to provide information regarding various parameters of the intake air, including ambient humidity, EGR, and fuel vapor amounts in the intake. Under some conditions, the reading from the intake oxygen sensor may be directly used to determine one or more of the above parameters. In other conditions, the intake oxygen amount may be determined and the relative contribution of the above parameters to the intake oxygen concentration may be modeled. Together, this information may be used to maintain the air/fuel ratio in each cylinder at an optimal level to improve fuel economy and reduce emissions. FIG. 1 is an example engine system including a controller, an intake oxygen sensor, and various sources of intake fuel vapors, such as a fuel tank vapor recovery system. FIG. 2 is a single cylinder diagram of the engine of FIG. 1. FIGS. 3 and 4A-4C are example control routines that may be carried out by the controller of FIG. 1 to adjust fuel injection based on the intake oxygen sensor during various engine operating conditions. FIG. 5 is a graph illustrating the relationship between intake oxygen concentration and fuel vapor amounts present in the intake.

FIG. 1 shows aspects of an example engine system 1 for a motor vehicle. The engine system is configured for combusting fuel vapor accumulated in at least one component thereof. The engine system includes engine 10.

Engine 10 may be virtually any volatile-liquid or gas-fueled internal combustion engine, e.g., a port- or direct-injection gasoline engine or diesel engine. In one, non-limiting embodiment, the engine may be adapted to consume an alcohol-based fuel—ethanol, for example.

Engine system 1 includes at least two sensors depicted in FIG. 1: manifold gas sensor 24 fluidically coupled to an air conduit downstream of throttle 62, and humidity sensor 26 fluidically coupled to an air conduit upstream of throttle 62. Sensor 24 may be any suitable sensor for providing an indication of intake gas concentration, such as a linear oxygen sensor or UEGO (universal or wide-range exhaust gas oxygen), a two-state oxygen sensor or EGO, a HEGO (heated EGO), a NOx, HC, or CO sensor. Additional sensors not shown in FIG. 1 may also be present, such as MAP, MAF, and temperature sensors. Each sensor in engine system 1 is operatively coupled to controller 12, which may be any electronic control system of the engine system or of the vehicle in which the engine system is installed. Accordingly, the electronic control system may be configured to make control decisions, actuate valves, etc., based at least partly on the gas concentrations sensed within the engine system. Additional information regarding controller 12 will be presented with respect to FIG. 2 below.

Intake manifold 44 is configured to supply intake air or an air-fuel mixture to a plurality of combustion chambers of engine 10. The combustion chambers may be arranged above a lubricant-filled crankcase 130, in which reciprocating pistons of the combustion chambers rotate a crankshaft. The reciprocating pistons may be substantially isolated from the crankcase via one or more piston rings, which suppress the flow of the air-fuel mixture and of combustion gasses into the crankcase. Nevertheless, a significant amount of fuel vapor may 'blow by' the piston rings and enter the crankcase over time. To reduce the degrading effects of the fuel vapor on the viscosity of the engine lubricant and to reduce the discharge of the vapor into the atmosphere, the crankcase may be continuously or periodically ventilated, as further described hereinafter. In the configuration shown in FIG. 1, post-throttle crankcase-ventilation valve 132 controls the admission of ventilation air into the crankcase. The post-throttle crankcase-ventilation valve may be any fixed or adjustable portioning valve.

Engine system 1 includes fuel tank 34, which stores the volatile liquid fuel combusted in engine 10. To avoid emission of fuel vapors from the fuel tank and into the atmosphere, the fuel tank is vented to the atmosphere through adsorbent canister 136. The adsorbent canister may have a significant capacity for storing hydrocarbon-, alcohol-, and/or ester-based fuels in an adsorbed state; it may be filled with activated carbon granules and/or another high surface-area material, for example. Nevertheless, prolonged adsorption of fuel vapor will eventually reduce the capacity of the adsorbent canister for further storage. Therefore, the adsorbent canister may be periodically purged of adsorbed fuel, as further described hereinafter. In the configuration shown in FIG. 1, post-throttle canister-purge valve 138 controls the admission of purge air into the adsorbent canister.

To provide venting of fuel tank 34 during refueling, adsorbent canister 136 is coupled to the fuel tank via refueling tank vent 140. The refueling tank vent may be a normally closed valve which is held open during refueling. To provide venting of the fuel tank while the engine is running, engine-running tank vent 142 is provided. The engine-running tank vent may be a normally closed tank vent which is held open while the engine is running. The engine-running tank vent, when open, may conduct vapors from the fuel tank to the intake manifold via buffer 144. The buffer may be any structure configured to reduce or restrict the admission of transient slugs of fuel vapor into the clean air intake conduit. Such slugs of fuel vapor could be caused by tank slosh, for example. The buffer may comprise one or more baffles, screens, orifices, etc.

The configuration illustrated in FIG. 1 ensures that during refueling, air from fuel tank 34, now stripped of fuel vapor, may be vented to atmospheric pressure. During other conditions, e.g., during a system integrity test, refueling tank vent 140 and engine-running tank vent 142 may be closed so that it can be determined whether some isolated part of engine system 1 can hold pressure or vacuum. In some embodiments, throttle 62, post-throttle crankcase-ventilation valve 132, post-throttle canister-purge valve 138, and tank vents 140 and 142 may be electronically controlled valves operatively coupled to controller 12 to facilitate such diagnostics, and other features of engine operation.

Continuing in FIG. 1, post-throttle crankcase-ventilation valve 132 is shown coupled to intake manifold 44 and to crankcase 130 via intake-protecting oil separator 146. In one embodiment, the direction of ventilation air flow through the crankcase depends on the relative values of the manifold air pressure (MAP) and the barometric pressure (BP). Under unboosted or minimally boosted conditions (e.g., when BP>MAP), air enters the crankcase from air cleaner 16 and is discharged from the crankcase to intake manifold 44.

FIG. 2 is a schematic diagram showing one cylinder of multi-cylinder engine 10, which may be included in a propulsion system of an automobile. Engine 10 may be controlled at least partially by a control system including controller 12 and by input from a vehicle operator 2 via an input device 4. In this example, input device 4 includes an accelerator pedal and a pedal position sensor 6 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown in FIG. 2) including a fuel tank, a fuel pump, and a fuel rail. In some embodiments, combustion chamber 30 may alternatively or additionally include a fuel injector arranged in the intake in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control devices 71 and 72. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control devices 71, 72 are shown arranged along exhaust passage 48 downstream of exhaust gas sensor 126. Devices 71, 72 may be a three way catalyst (TWC), NOx trap, various other emission control devices, or combinations thereof. In some embodiments, during operation of engine 10, emission control devices 71, 72 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including intake gas concentration from sensor 24; measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 2 shows only one cylinder of a multi-cylinder engine, and that each cylinder may similarly include its own set of intake/exhaust valves, fuel injector, spark plug, etc.

Further, in the disclosed embodiments, an exhaust gas recirculation (EGR) system may route a desired portion of exhaust gas from exhaust passage 48 to intake manifold 44 via EGR passage 170. The amount of EGR provided to intake manifold 44 may be varied by controller 12 via EGR valve 174. Further, an EGR sensor 172 may be arranged within the EGR passage and may provide an indication of one or more pressure, temperature, and concentration of the exhaust gas. Under some conditions, the EGR system may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

Thus, the system of FIGS. 1 and 2 may provide for an engine system comprising a cylinder, a fuel injection system, an intake system coupled to the cylinder and including an oxygen sensor, and a control system including instructions to adjust fuel injection amount based on an external fuel concentration in the intake system, the external fuel comprising fuel from a positive crankcase ventilation system, fuel from a fuel vapor canister, and/or fuel evaporated from an intake valve and/or intake port.

Figure 3:
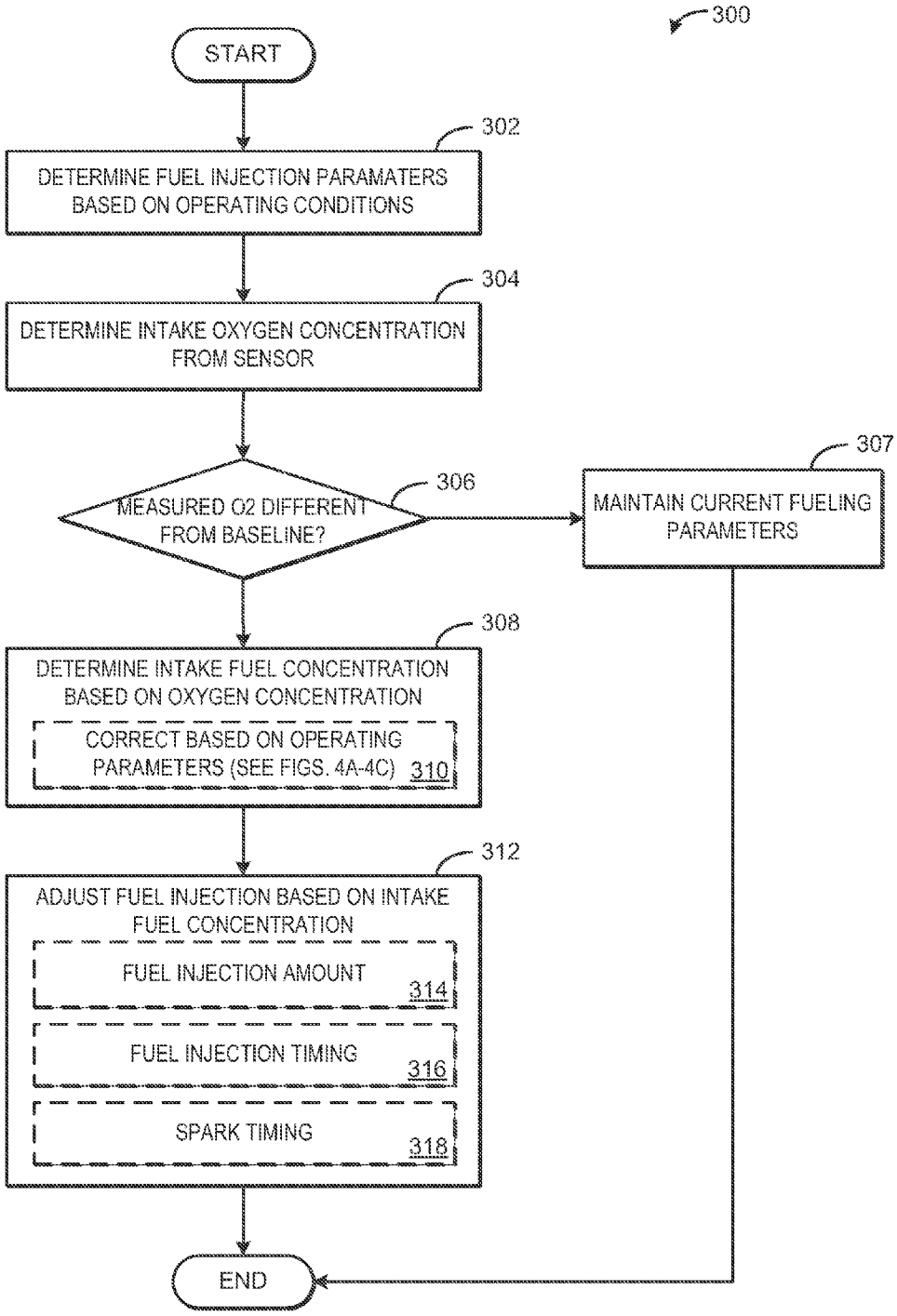
FIG. 3 shows flow chart illustrating a high level control routine for adjusting fuel injection based on feedback from an intake oxygen sensor according to an embodiment of the present disclosure.

Turning to FIG. 3, an example high level control routine 300 for adjusting fuel injection is depicted. Routine 300 may be carried out by a controller, such as controller 12, in response to feedback from various sensors of the engine system, such as intake gas sensor 24.

At 302, fuel injection parameters are determined based on engine operating parameters. The fuel injection parameters may include fuel injection amount and timing, as well as other parameters such as spark timing. The fuel injection parameters may be based on engine speed, engine load, manifold absolute temperature, engine temperature, etc. Further, the fuel injection parameters may be adapted based on feedback from one or more downstream air/fuel ratios, such as sensor 126. In some examples, a desired air/fuel ratio, such as a stoichiometric air/fuel ratio, may be determined based on the various engine operating parameters, and the fuel amount injected may be adapted based on the air/fuel ratio determined by the downstream sensors in order to maintain the desired air/fuel ratio.

As explained previously, under certain conditions such as fuel vapor canister purging, additional fuel may be present in the intake manifold. When adaptive fuelling strategies are based on feedback from downstream sensors, this fuel in the intake may not be accounted for, resulting in over-fueling in some conditions. To avoid this, feedback from an intake gas sensor may also be used to determine fuel injection parameters. As such, at 304, the concentration of oxygen in the intake is determined based on a gas sensor in the intake. At 306, it is determined if the measured oxygen concentration is different from a baseline oxygen concentration stored in the memory of the controller. This baseline oxygen concentration may be determined under conditions where no fuel or EGR is present in the intake, such as immediately following a cold engine start. This baseline concentration may also account for ambient humidity present in the air. In other embodiments, the baseline concentration may be a preset amount based only the amount of oxygen typically present in the atmosphere, and the humidity corrected for using a humidity sensor in the intake.

If the oxygen concentration is not different from baseline, routine 300 proceeds to 307 to maintain the current fueling parameters determined at 302. If the measured oxygen concentration is different from the baseline concentration, routine 300 proceeds to 308 to determine the intake fuel concentration based on the intake oxygen concentration. As shown in FIG. 5, any deviations from a predetermined level of ambient oxygen in the intake air may be attributed to fuel present in the intake. For example, ambient oxygen levels may be around 20%, as measured by the intake oxygen sensor when no fuel (or EGR) is present in the intake. An intake oxygen sensor reading of 16% may indicate that 1% of the intake volume is comprised of fuel, for example.

Determining the intake fuel concentration may include, in some conditions, correcting the fuel concentration based on operating parameters at 310. EGR present in the intake may lower intake oxygen concentration, and ambient humidity in the air may also alter intake oxygen amounts. Further, the intake fuel may derive from multiple sources, such as from the PCV system, fuel puddles on the intake ports, and pushback fuel arising during certain events such as intake/exhaust valve overlap. While the oxygen sensor may be able to detect fuel from all these sources, under some conditions the sensor may not detect them all, or may be subject to too much noise to accurately determine the fuel concentration. Additionally, adaptive fuel strategies may compensate for evaporating fuel from a fuel puddle that is then also measured by the intake gas sensor, resulting in fueling errors. The conditions likely to confound the determination of the fuel concentration, and mechanisms for correcting the fuel concentration based on the conditions, are discussed in more detail below with respect to FIGS. 4A-4C.

At 312, the fuel injection parameters set at 302 may be adjusted based on the determined intake fuel concentration. Adjusting the fuel injection may include adjusting a fuel injection amount at 314. If the intake air includes an appreciable amount of fuel, the fuel injection amount may be reduced to compensate for this additional fuel. Additionally, because the intake fuel is likely to already be vaporized and homogenized by the time it enters the cylinder, under some conditions, the dynamics of when the fuel is injected and ignited may be altered as a result of the fuel in the intake. Further, the intake gas sensor may be able to detect EGR and/or humidity, and these factors may also effect injection and spark timing. Thus, to maintain optimal combustion conditions, fuel injection may be adjusted at 316 and spark timing may be adjusted at 318. Upon either maintaining fuel injection at 307 or adjusting fuel injection at 312, routine 300 ends.

Figure 4A:
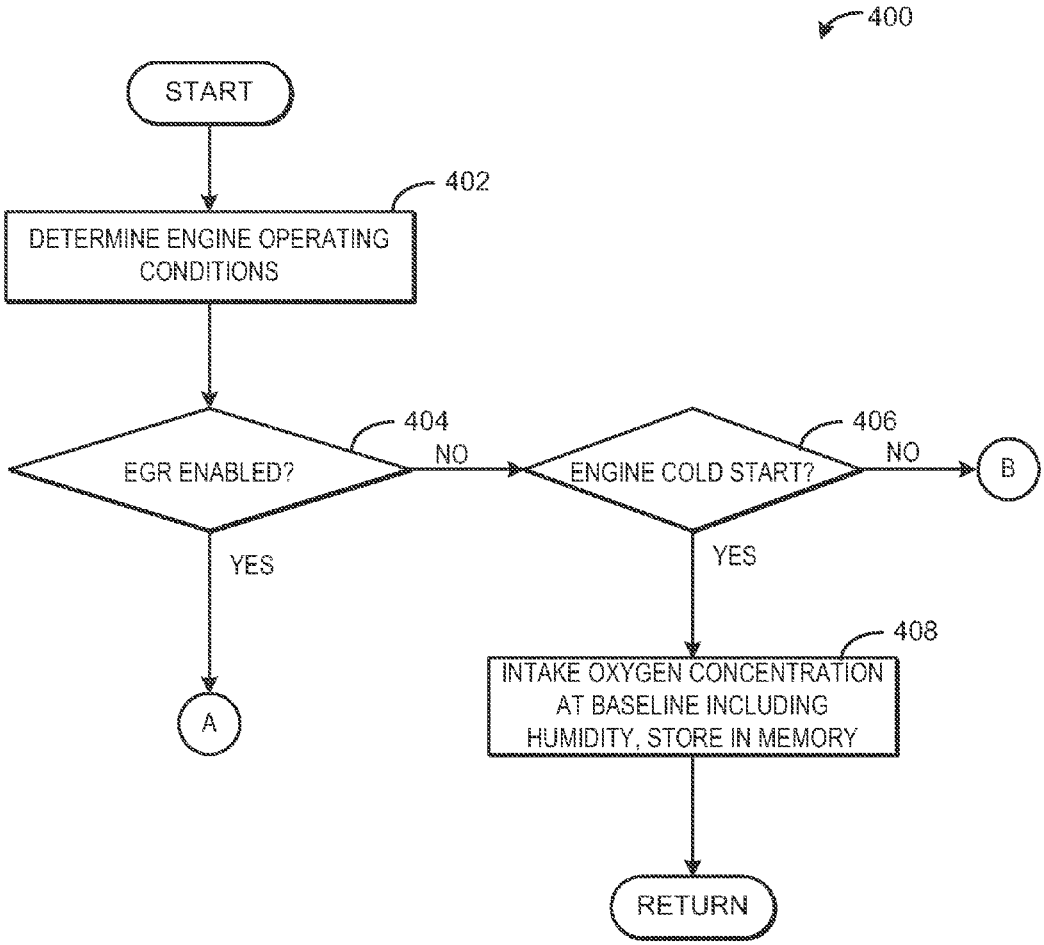
FIGS. 4A-4C show flow charts illustrating a control routine for correcting a fuel concentration amount according to an embodiment of the present disclosure.
Figure 4B:
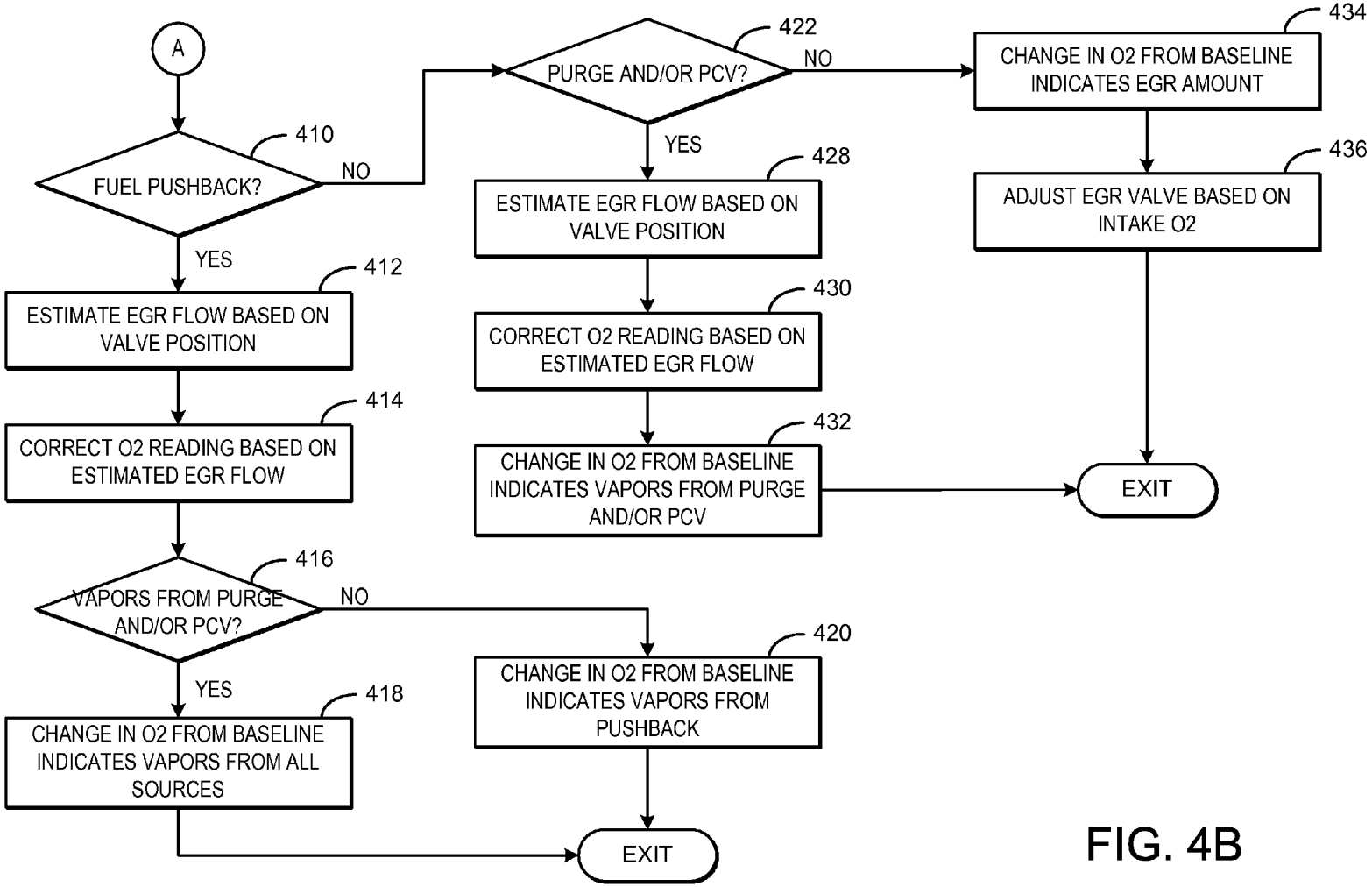
Figure 4C:
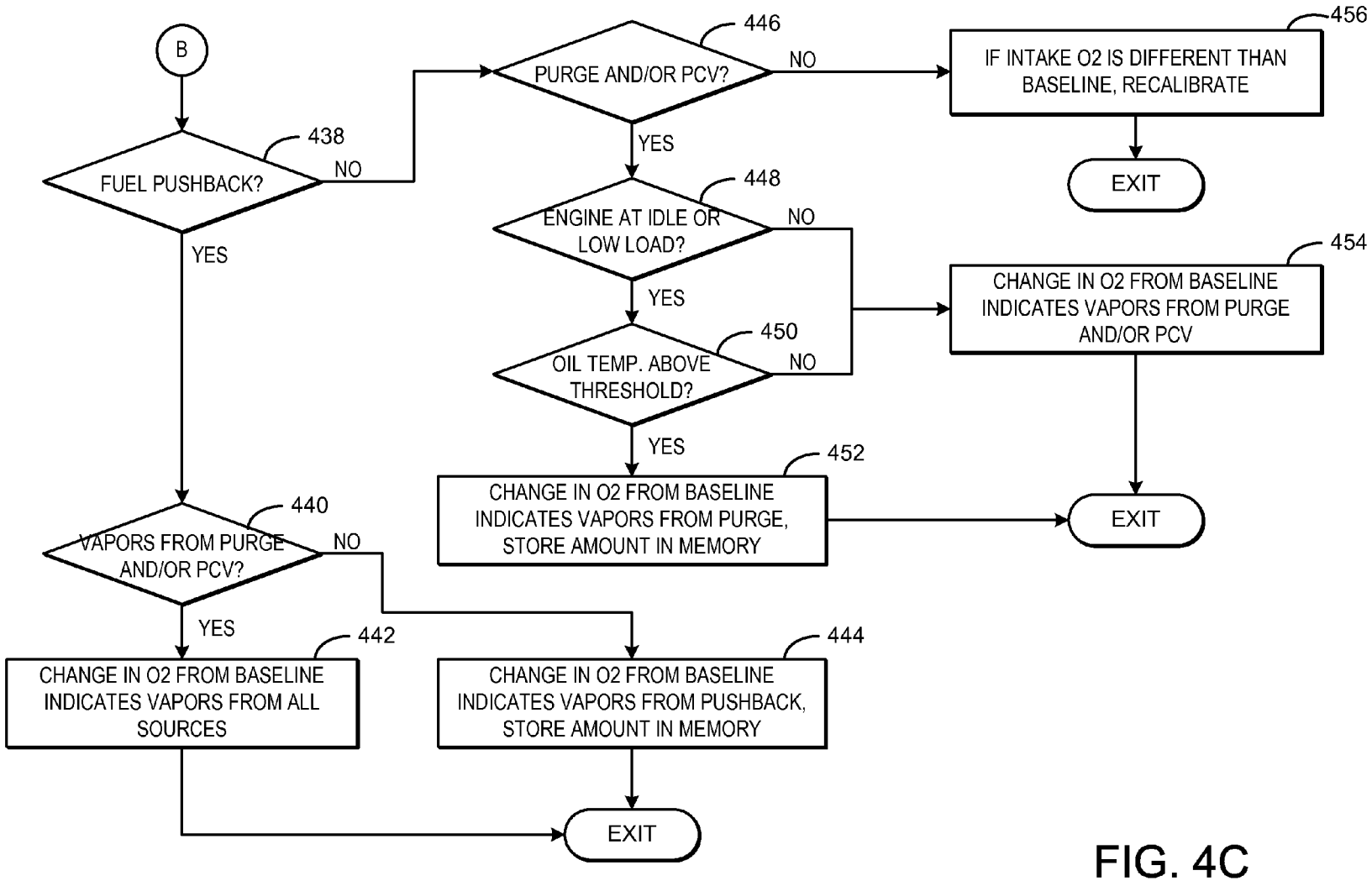
Figure 5:
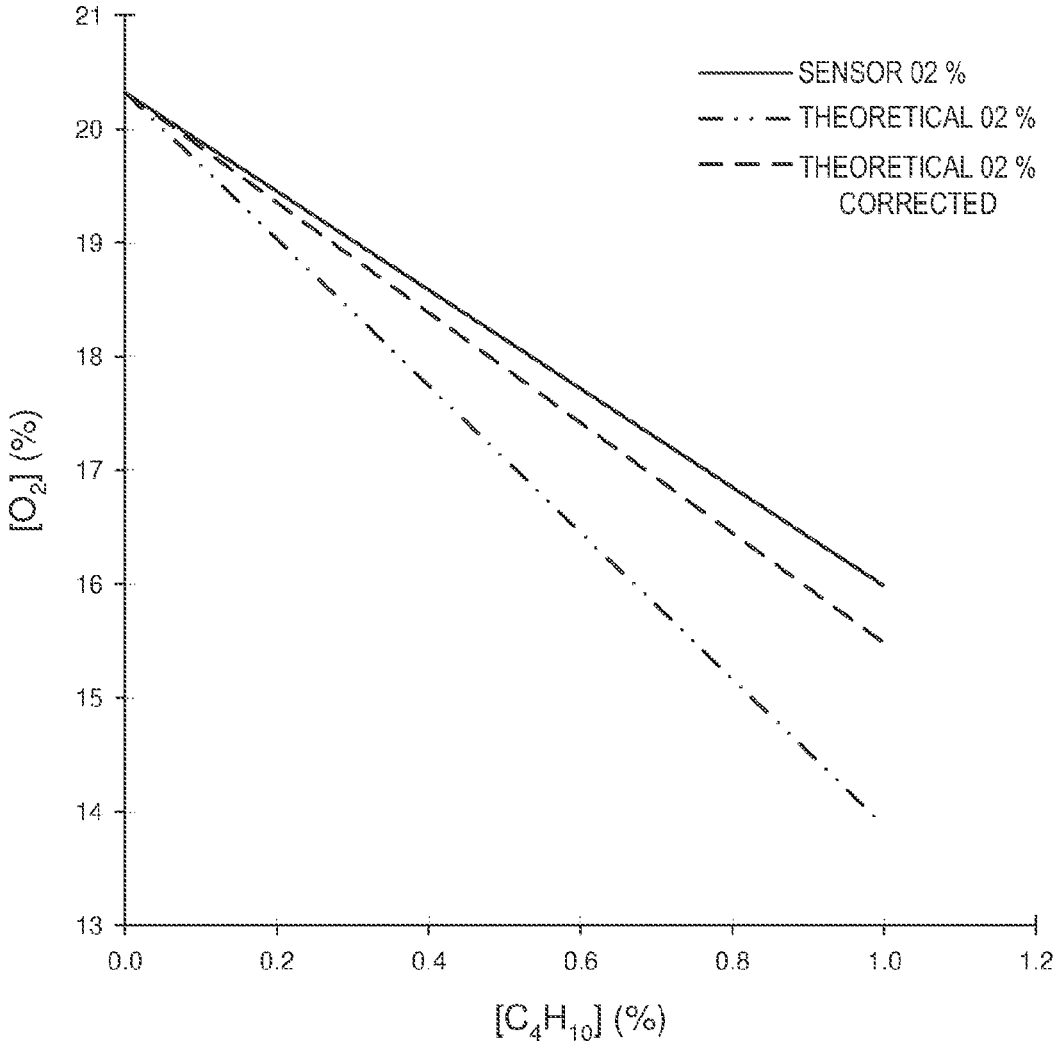
FIG. 5 shows an example diagram illustrating a relationship between an intake oxygen concentration and an intake fuel concentration.

FIGS. 4A-4C depict a routine 400 for correcting a fuel concentration determination in the intake of the engine. Routine 400 may be carried out by the controller during the execution of routine 300, for example at 310, described above with respect to FIG. 3.

Turning to FIG. 4A, routine 400 includes, at 402, determining engine operating conditions. The determined engine operating conditions may include engine speed, load, temperature, number of engine cycles since engine start, camshaft position, fuel injection amount and timing, spark timing, etc. At 404, it is determined if EGR is enabled. EGR may be enabled when engine speed and load are above a threshold, for example if the engine is not at idle and engine speed is above 500 RPMs. Further, EGR may be enabled only if engine temperature is at warmed-up engine operating temperature. If it is determined that EGR is enabled, routine 400 proceeds to 410 of FIG. 4B, which will be discussed in more detail below. IF EGR is not enabled, at 406, it is determined if the engine is in cold start conditions. This may include engine temperature being below a threshold, e.g., 100° F., and/or being less than a threshold number of cycles since engine start, such as 100 cycles. If it is determined that the engine is in cold start conditions, routine 400 proceeds to 408 to set the measured intake oxygen amount as a baseline oxygen concentration, which also includes oxygen present from the ambient humidity in the air. This baseline oxygen concentration may be stored in the memory of the controller for use in determining the fuel concentration in the intake, which will be described in more detail below with respect to FIGS. 4B and 4C. If the engine is not in cold start conditions, routine 400 proceeds to 438 of FIG. 4C, which will be described in more detail below.

FIG. 4B depicts a subset of routine 400 in which intake oxygen concentration may be used to determine intake fuel concentration and/or the EGR percentage in the intake, while EGR is enabled. At 410, it is determined if the operating conditions indicate there may be pushback fuel in the intake. Example conditions which may arise in pushback fuel include positive intake/exhaust valve overlap, late intake valve closing, and one or more fuel puddles in an intake port or valve that is changing in size due to evaporation of the fuel puddle at a greater rate than fuel accumulation in the puddle. These may be determined by the position of the camshaft, or position of the intake valves, relative to piston position. Pushback fuel conditions may also be determined by the amount and timing of fuel injections in the previous engine cycles. If it is determined that conditions for pushback fuel are present, routine 400 proceeds to 412 to estimate EGR percentage in the intake based on EGR valve position, MAP, MAF, etc. Because both EGR and pushback fuel are present in the intake, the measured oxygen concentration indicates reduction in oxygen concentration from both fuel in the intake and EGR. EGR percentage may be estimated so that the remaining reduction in oxygen concentration may be attributed just to the fuel in the intake. Thus, at 414, the oxygen concentration reading may be corrected by the estimated EGR percentage.

At 416, it is determined if conditions are present for additional fuel in the intake from a fuel vapor canister purge and/or from the positive crankcase ventilation system. Purge conditions may include the fuel vapor canister being in a regeneration state, e.g., the canister may be at its capacity to store fuel vapors. This may be determined by a position of a valve controlling the fuel vapor canister, or by an amount of time since a previous purge. Fuel from the PCV system may be present in the intake when oil temperature is below standard warmed up temperature, and so may be present if engine temperature is below a threshold (such as the cold start temperature discussed above with respect to 406 of FIG. 4A). Determination of whether fuel in the intake from the PCV system is present may be based on a position of the crankcase ventilation valve.

If it is determined that conditions indicative of PCV and/or purge fuel are present, routine 400 proceeds to 418 to attribute the measured change in oxygen concentration from a baseline oxygen concentration to all external fuel sources, including fuel from pushback and from PCV and/or purge. The intake oxygen sensor cannot differentiate these sources from each other, but can adjust the fuel injection amount based on the total fuel concentration in the intake. However, the relative contribution of each source may be determined under other conditions, which will be described in more detail below.

If it is determined that conditions indicative of PCV and/or purge fuel are not present, routine 400 proceeds to 420 to attribute the change in oxygen concentration in the intake from a baseline concentration to fuel from pushback only.

Returning to 410, if it is determined that conditions resulting in fuel pushback are not present, routine 400 proceeds to 422 to determine if conditions for purge and/or PCV are present, similar to the conditions determined at 416. If purge and/or PCV fuel are present in the intake, routine 400 proceeds to 428 to estimate EGR percentage based on EGR valve position and other intake flow parameters. At 430, the oxygen sensor reading is corrected to account for the estimated EGR percentage. At 432, the change in oxygen concentration detected by the sensor is attributed to vapors from purge and/or PCV only.

If it is determined at 422 that purge and/or PCV fuel is not present in the intake, routine 400 proceeds to 434 attribute the change in oxygen concentration detected by the sensor to the EGR present in the intake. As no fuel is present in the intake, this reading may be used directly to monitor the EGR percentage in the intake and used to adjust the EGR valve at 436 to maintain a desired EGR percentage in the intake. After determining what fuel sources are present in the intake at 418, 420, or 432, or after adjusting the EGR valve at 436, routine 400 exits.

Thus, FIG. 4B depicts a subset of routine 400 that may be used when EGR is enabled, to correct the oxygen sensor reading for the EGR in the intake. In this way, any additional changes to the oxygen concentration in the intake not due to the EGR may be attributed to fuel sources such as a fuel vapor canister purge, PCV system, or from pushback. Based on operating conditions, the source of the fuel in the intake may be determined. However, due to the EGR present in the intake, the overall change in the oxygen concentration may be caused by both the EGR and fuel sources in the intake, thus the EGR amount in the intake is estimated, and the remaining oxygen concentration attributed to the fuel sources in the intake. These fuel sources may also be estimated based on predetermined fuel amounts expected to be present in the intake during various operating conditions. The subset of routine 400, discussed with respect to FIG. 4C, may be performed when EGR is not enabled to determine the amounts of each of the fuel sources.

FIG. 4C depicts routine 400 following the determination at 406 that EGR is not enabled and that the engine is not in cold start conditions. At 438 of FIG. 4C, it is determined if fuel pushback conditions are present. If pushback conditions are present, routine 400 proceeds to 440 to determine if vapors from purge and/or PCV are present. If so, at 442, the change in oxygen concentration from baseline is attributed to all fuel sources, which cannot be differentiated from each other. However, if conditions for either canister purge or PCV fuel are not present, at 444, the change in oxygen concentration detected may be attributed to only fuel from pushback. This measured amount may be stored in the memory of the controller for future use in modeling fuel amounts present in the intake.

If it is determined at 438 that fuel pushback conditions are not present, routine 400 proceeds to 446 to determine if canister purge vapors and/or PCV fuel is present in the intake. If yes, routine 400 proceeds to 448 to determine if the engine is operating at idle or low load conditions. During idle or low load conditions, the amount of airflow through the intake is relatively low compared to higher load operating conditions. As a result, if the fuel vapor canister is in a purge condition, the purge flow may comprise a significant enough proportion of the airflow to be accurately measured by the oxygen sensor. If the engine is not operating in idle or low load, the conditions may not be optimal for accurate purge flow determination, and routine 400 proceeds to attribute the fuel in the intake to purge and/or PCV at 454, without storing the determination for future use.

If the engine is operating at idle or low load, at 450 it is determined if oil temperature is above a threshold, based on a determination of engine temperature. When oil temperature is above the threshold, it may be possible to accurately determine the purge flow amount, as the fuel from PCV system will not be present in the intake. The threshold may be warmed-up engine temperature or another suitable threshold that indicates a lack of appreciable fuel deriving from the PCV system (as fuel from the PCV system tends to be present in the intake only while the oil in the engine is warming up). If oil temperature is above the threshold, routine 400 proceeds to 452 to attribute the change in measured oxygen concentration to fuel only from the fuel vapor canister purge, and store this amount in memory for future use. If oil temperature is not above the threshold, routine 400 proceeds to 454 to attribute the fuel in the intake to purge and/or PCV. However, under some circumstances, if the amount of fuel in the intake during a fuel vapor purge is known based on previous measurements (such as the amount determined at 452), this amount may be subtracted out from the amount determined at 454, and the remaining amount attributed to just fuel from the PCV system.

Returning to 446 of FIG. 4C, if it is determined that conditions for purge and/or PCV fuel are not present, it likely there is no fuel in the intake. Thus, the measured oxygen concentration should be the same as baseline. However, if it is not, routine 400 proceeds to 456 to recalibrate the baseline oxygen concentration. Upon determining the source of the fuel in the intake at 442, 444, 452, or 454, or determining there is no fuel in the intake 456, routine 400 exits.

Thus, routine 400 as depicted in FIGS. 4A-4C may provide various mechanisms for determining the source or sources of fuel present in the intake. Further, routine 400 may determine if EGR is present in the intake. This information may be based on readings from an oxygen sensor present in the intake and further based on various engine operating parameters. This information may then be used to adjust fuel injection in order to maintain the air/fuel ratio in the cylinders at a desired air/fuel ratio.

Intake oxygen readings can be used to provide information on various parameters, including ambient humidity, the amount of EGR in the intake, and the amount of fuel vapors in manifold (from fuel vapor, PCV, and/or pushback). During selected conditions, intake oxygen can provide information on each of the above singly. For example, when EGR is disabled and there is no canister vapor purge and no PCV, the intake oxygen reading provides the amount of fuel in the intake from pushback. When EGR is disabled and there is no pushback or PCV fuel in the intake, the intake oxygen reading provides the amount of fuel in the intake from the fuel vapor canister purge. In another example, when EGR is enabled but there is no fuel from a canister purge, pushback or the PCV system, the intake oxygen reading may provide the amount of EGR in the intake.

When conditions are present that allow for the determination of the concentration of intake oxygen due to a single factor (e.g. only pushback) this determined concentration can be used to directly determine the amount of fuel in the intake from that source, and that amount stored in the memory of the controller. Each of the above factors that affect the intake oxygen concentration may also be modeled, e.g., EGR flow may be modeled from EGR pressures and/or valve position, pushback can be estimated from valve timing and fuel injection parameters from the previous cycle, etc. By storing the amount of fuel present from each source in some conditions and modeling the amount from each source in other conditions, fuel amounts in the intake may be determined even if too much noise is present to accurately use the sensor for intake fuel determination. For example, if there is a significant amount of pushback fuel and the fuel vapor canister is in purge state during high engine load, the sensor may have a low signal-to-noise ratio and thus not provide an accurate determination of the intake fuel amount. In such conditions, the amount of fuel vapors released to the intake during a purge can be estimated based on previous determinations in better conditions, and the amount of pushback modeled based on valve timing and fuel injection parameters from the previous cycle, to provide an estimation of the fuel present in the intake.

Thus, the routines of FIGS. 3 and 4A-4C may provide for a method comprising, during purging of fuel vapors from a fuel vapor storage system, adjusting fuel injection to an engine based on an amount of fuel vapors indicated from an intake oxygen amount measured by a sensor; and fuel pushback into the intake only during positive valve overlap. FIGS. 3 and 4A-4C may also provide a method comprising, during EGR operation without fuel-vapor purging, adjusting an EGR valve to maintain a desired EGR amount, during fuel vapor purging without EGR, adjusting fuel injection based on intake oxygen concentration to maintain a desired air-fuel ratio, and during pushback without fuel vapor purging and without EGR, adjusting fuel injection based on intake oxygen concentration to compensate for fuel pushback from other cylinders.

In some embodiments, adjusting the EGR valve may comprise during pushback, adjusting the EGR valve to decrease EGR percentage by a first amount based on a decrease in intake oxygen concentration, and without pushback, adjusting the EGR valve to decrease EGR percentage by a second amount, greater than the first, based on the decrease in intake oxygen concentration. In this way, the EGR valve may be adjusted based on the determined intake oxygen concentration. If the intake air includes fuel vapors from pushback, for example, the EGR valve may adjusted by a different amount than if the intake air does not include fuel vapors, for the same determined intake oxygen concentration.

In another example, the method may further comprise, during fuel vapor purging with EGR, adjusting fuel injection based on intake oxygen concentration and further based on an estimated EGR flow. In some embodiments, this may further comprise correcting the intake oxygen concentration for the estimated EGR flow, and if the corrected intake oxygen concentration is lower than a baseline oxygen concentration, then decreasing a fuel injection amount.

In another example, the method may comprise adjusting fuel injection based on intake oxygen concentration and fuel pushback into the intake during positive valve overlap, and the adjusting fuel inject may further comprise decreasing a fuel injection amount if the intake oxygen concentration is less than a baseline oxygen concentration.

Thus, the fuel injection amount may be decreased if the measured intake oxygen concentration is less than a baseline oxygen concentration. A decrease in the oxygen concentration from baseline is indicative of fuel vapors present in the intake, and thus the fuel injection amount may be decreased to compensate for the fuel in the intake.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

during a first condition, adjusting fuel injection based on fuel concentration in an engine intake manifold; and during a second condition including operation at idle and when EGR is disabled, adjusting fuel injection based on the fuel concentration and an estimated fuel pushback amount.

2. The method of claim 1, wherein adjusting the fuel injection based on the fuel concentration in the intake manifold further comprises determining the fuel concentration based on an oxygen concentration in the intake manifold.

3. The method of claim 1, wherein the fuel in the intake manifold comprises fuel vapors purged from a fuel canister of a fuel tank vapor recovery system.

4. The method of claim 1, wherein the fuel in the intake manifold comprises fuel vapors from a positive crankcase ventilation system.

5. The method of claim 1, wherein the amount of pushback fuel is determined based on a change in fuel puddle size.

6. The method of claim 1, wherein the amount of pushback fuel is determined based on camshaft position relative to piston position.

7. The method of claim 1, wherein adjusting fuel injection further comprises adjusting an amount of fuel injected.

8. The method of claim 1, further comprising adjusting spark timing based on the fuel concentration and/or fuel pushback amount.

9. The method of claim 1, further comprising adjusting fuel injection based on humidity in the intake manifold.

10. A method, comprising:

during purging of fuel vapors from a fuel vapor storage system, adjusting fuel injection to an engine based on:

an amount of fuel vapors indicated from an intake oxygen amount;

fuel pushback into the intake during positive valve overlap; and ambient humidity; and during non-purging conditions, determining ambient humidity based on the intake oxygen amount.

11. A method, comprising:

during EGR operation without fuel-vapor purging, adjusting an EGR valve to maintain a desired EGR amount;

during fuel vapor purging without EGR, adjusting fuel injection based on intake oxygen concentration to maintain a desired air-fuel ratio; and during pushback without fuel vapor purging and without EGR, adjusting fuel injection based on intake oxygen concentration to compensate for fuel pushback from other cylinders.

12. The method of claim 11, wherein adjusting the EGR valve further comprises:

during pushback, adjusting the EGR valve to decrease EGR percentage by a first amount based on a decrease in intake oxygen concentration; and without pushback, adjusting the EGR valve to decrease EGR percentage by a second amount, greater than the first amount, based on the decrease in intake oxygen concentration.

13. The method of claim 11, further comprising, during fuel vapor purging with EGR, adjusting fuel injection based on intake oxygen concentration and further based on an estimated EGR flow.

14. The method of claim 13, wherein adjusting fuel injection based on intake oxygen concentration and further based on an estimated EGR flow further comprises:

correcting the intake oxygen concentration for the estimated EGR flow; and if the corrected intake oxygen concentration is lower than a baseline oxygen concentration, then decreasing a fuel injection amount.

15. The method of claim 11, wherein during fuel vapor purging without EGR, adjusting fuel injection based on intake oxygen concentration further comprises adjusting fuel injection based on intake oxygen concentration and fuel pushback into an intake during positive valve overlap.

16. The method of claim 15, further comprising decreasing a fuel injection amount if the intake oxygen concentration is less than a baseline oxygen concentration.

* * * * *